US012708152B2

(12) United States Patent
Sofer et al.

(10) Patent No.: US 12,708,152 B2
(45) Date of Patent: Aug. 18, 2026

(54) GARMENT FOR MALES

(71) Applicant: KETO PTY LTD, McKinnon (AU)

(72) Inventors: Jacob Sofer, Malvern (AU); Peggy Cherie Jackson, Malvern (AU)

(73) Assignee: KETO PTY LTD, McKinnon (AU)

( * ) Notice: Subject to any disclaimer, the term of this patent is extended or adjusted under 35 U.S.C. 154(b) by 0 days.

(21) Appl. No.: 18/853,179

(22) PCT Filed: Mar. 31, 2023

(86) PCT No.: PCT/AU2023/050249
§ 371 (c)(1),
(2) Date: Oct. 1, 2024

(87) PCT Pub. No.: WO2023/183985
PCT Pub. Date: Oct. 5, 2023

(65) Prior Publication Data

US 2025/0212973 A1 Jul. 3, 2025

(30) Foreign Application Priority Data

Apr. 1, 2022 (AU) ..... 2022900857

(51) Int. Cl.
*A41B 9/02* (2006.01)
*A41B 9/00* (2006.01)

(52) U.S. Cl.
CPC ..... *A41B 9/023* (2013.01); *A41B 9/004* (2013.01); *A41B 9/02* (2013.01); *A41B 2300/52* (2013.01); *A41B 2500/50* (2013.01)

(58) Field of Classification Search
CPC ..... A41B 9/023; A41B 9/004; A41B 9/02; A41B 2300/52; A41B 2500/50
See application file for complete search history.

(56) References Cited

U.S. PATENT DOCUMENTS 3,547,117 A * 12/1970 Smithers ..... A41B 9/02 2/403
4,471,772 A 9/1984 Miller, Jr.
5,094,234 A * 3/1992 Searcy ..... A61F 5/40 602/73
10,682,563 B2 * 6/2020 Yang ..... A41D 13/05
(Continued)

FOREIGN PATENT DOCUMENTS

CN 205947133 U 2/2017
GB 2459261 A 10/2009
(Continued)

OTHER PUBLICATIONS

International Patent Application No. PCT/AU2023/050249, International Search Report dated May 25, 2023, 4 pages.
(Continued)

*Primary Examiner* — Khaled Annis
(74) *Attorney, Agent, or Firm* — Leber IP Law; Celia H. Leber

(57) ABSTRACT

A garment/undergarment for males configured to provide support to the male genitalia during activity, particularly athletic or strenuous activity, the garment/undergarment comprising a moulded cup and comprising seams configured to be substantially invisible underneath tight clothing and wherein the seams are not stitched.

14 Claims, 9 Drawing Sheets

(56) References Cited

U.S. PATENT DOCUMENTS

2003/0114810 A1* 6/2003 Weber ..... A61F 13/496 604/362
2005/0148980 A1* 7/2005 Fitton ..... A61F 13/505 604/385.3
2005/0278839 A1 12/2005 Atwater et al.
2006/0030238 A1* 2/2006 Jagaric ..... A41C 5/005 450/57
2007/0044209 A1* 3/2007 Maurer ..... A41B 9/023 2/403
2012/0084896 A1* 4/2012 Wyner ..... B32B 27/304 2/24
2012/0131719 A1* 5/2012 Diamant ..... A41B 9/02 2/69
2013/0244526 A1* 9/2013 Wyner ..... B32B 5/18 428/319.7
2014/0100505 A1* 4/2014 Vargas Snyder ... A63B 71/1216 602/70
2019/0029328 A1* 1/2019 Anderson ..... A61F 5/40
2020/0268062 A1* 8/2020 Palese ..... A41C 3/12
2021/0368871 A1* 12/2021 Palese ..... A41C 3/142
2023/0194370 A1* 6/2023 Brush ..... A63B 71/10 482/8
2024/0292908 A1* 9/2024 Perez ..... A41B 9/02
2024/0407475 A1* 12/2024 Ziehmer ..... A41B 9/12
2024/0415204 A1* 12/2024 Ishiguro ..... D06C 7/02
2025/0040626 A1* 2/2025 Zhu ..... A41C 3/0057
2025/0151824 A1* 5/2025 Palese ..... A41C 3/12
2025/0160445 A1* 5/2025 Wilson, II ..... A41B 9/14
2025/0176645 A1* 6/2025 Migliozzi ..... A41C 3/0057

FOREIGN PATENT DOCUMENTS

GB 2475234 A 5/2011
KR 20140041981 A 4/2014
KR 102065495 B1 1/2020

OTHER PUBLICATIONS

International Patent Application No. PCT/AU2023/050249, Written Opinion dated May 25, 2023, 7 pages.

* cited by examiner

Prior Art

GARMENT FOR MALES

RELATED APPLICATIONS

This application is a national phase entry of International Patent Application No. PCT/AU2023/050249, filed Mar. 31, 2023, which claims priority from Australian Patent Application No. 2022900857, filed Apr. 1, 2022, the entire disclosures of which are incorporated herein by reference.

FIELD OF THE INVENTION

The present invention relates to active-wear garments for males, and particularly to garments configured to provide support to the male genitalia during physical activity, particularly athletic or strenuous activity.

The invention has been developed primarily for use as a supportive undergarment for male dancers and will be described hereinafter with reference to this application. However, it will be appreciated that the invention is not limited to this particular field of use.

BACKGROUND

Any discussion of the background art throughout the specification should in no way be considered as an admission that such background art is prior art, nor that such background art is widely known or forms part of the common general knowledge in the field in Australia or worldwide.

All references, including any patents or patent applications, cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents forms part of the common general knowledge in the art, in Australia or in any other country.

There are several known drawbacks and disadvantages associated with wearing conventional men's briefs, particularly for exercise or other athletic or strenuous activity. These drawbacks and disadvantages include discomfort from chaffing, insufficient support, and the presence of moisture and/or increased warmth some men experience when wearing conventional briefs.

In the field of professional dance, male dancers are limited in the choice of briefs capable of providing support to the genitalia, with the only acceptable option for a long time being the jockstrap or dance belt for support the male genitals and prevent testicular injury, while also creating a smooth and neat aesthetic look for performances. Dance belts were developed and are considered desirable for male dancers and others to wear because various choreographic moves can otherwise result in pain or possibly even injury to the male genitalia which are not supported nor held snugly in place against the lower abdominal area. Also skin-tight, body-hugging ballet tights would otherwise reveal the contours of the male dancer's anatomy to a degree of detail which could be considered distracting to the audience.

Such dance belts 10, such as shown in FIG. 1 for example, however, have been designed and constructed using old fashioned sewing and quilting methods resulting in poorly shaped, ill fitting, and unsupportive products. Such stitched construction provides little-to-no flexibility in the support provided during activity. Most dance belt designs are similar to that of thong or G-string underwear and, due to the elastic compression required to maintain support for the wearer's genitalia through the stitched or quilted pouch 12, are considered to be extremely uncomfortable by many professional dancers for long term wear. The construction techniques that have been used in dance belt construction to date, mainly needle and thread construction, necessarily limit the designs and fits that can be achieved. Also, the stitched construction method is prone to cause discomfit to the wearer through irritation from the stitched thread rubbing against the skin and general discomfit. As the dance belt must be worn quite tight and snug to provide sufficient support for the dance belt to perform as required, the stitched seams are liable to failure in joins or areas under high tension and/or stretch. Many other significant problems are associated with existing dance belt garments including: failure/degradation of the elasticised waist-belt 14 over time; loss of shape and form including sag of the dance belt as it becomes moist due to sweat during vigorous activity. An alternative to the traditional dance belt is the jockstrap commonly used in sports outside of professional dance, however, such existing jockstrap designs are even less supportive or suitable to the physical athletic demands of the male professional dancer. Despite the many deficiencies of existing dance belt or jockstrap designs, they have been the de facto standard for professional male dancers, gymnasts, acrobats, athletes, performers and entertainers for many decades with only incremental improvements on the basic design and structure that have done little in overcoming the above problems. Indeed, it is common for professional male dancers to wear two dance belts simultaneously in an attempt to alleviate some of the design deficiencies, particularly those of garment sag and unsightly visual appearance.

Thus, a need exists for an improved garment/undergarment for males, for example, a dance belt, configured to provide support to the male genitalia during activity, particularly athletic or strenuous activity and improved construction methods for garment/undergarments such as dance belts or jockstraps, which fulfil the support and aesthetic requirements of male dancers, performers, athletes, etc, whilst improving the wearer's comfort whilst wearing the garment/undergarment.

SUMMARY

It is an object of the present invention to overcome or ameliorate at least one or more of the disadvantages of the prior art, or to provide a useful alternative.

According to a first aspect of the present invention, there is provided a garment for males comprising a moulded cup adapted for supporting the wearer's genitalia.

The garment may be configured to provide support and protection to the male genitalia during physical activity, particularly athletic or strenuous activity. In general terms, the support and protection provided to the male wearer's genitalia is achieved through the design of a soft foam moulded cup which is integrated into the garment.

The garment may be an undergarment.

The garment may comprise seams configured to be substantially invisible underneath tight clothing. The seams may be not stitched. The seams may be bonded. The seams may be formed from a folded bonding, ultrasonic fused bond or overlap bonded seam.

The moulded cup may be formed from a foam material comprising:

polyurethane foam;

polyester foam; or ethylene-vinyl acetate (EVA) foam.

The moulded cup may conform to the appropriate shape for supporting the genitalia of the male wearer. The moulded cup may vary in thickness to conceal form of the wearer's genitalia when worn underneath tight-fitting clothing. The moulded cup may comprise rolled/rounded edges to minimise or prevent discomfort to the male wearer in particular predetermined regions of higher friction. The moulded cup may comprise edges in predetermined regions comprising a highly tapered edge to blend with the fabric of a waistband of the garment. The edges of the cup may be smoothly varying between highly tapered and rounded in predetermined regions.

The garment may be tight-fitted garment for males comprising a moulded cup.

The garment may comprise a plurality of seams wherein the seams are not stitched. The plurality of seams may be bonded. The seams may be substantially invisible when the garment is worn under tight fitting outer garments.

The garment may further comprise a cup receiving pouch adapted to receive a rigid protective cup formation. The rigid moulded cup may be formed of a rigid material adapted to provide impact protection to the wearer's genitalia. The protective cup may comprise a rigid over-cup formed of a rigid material configured to encase the moulded cup, the rigid over-cup being adapted to provide impact protection to the wearer's genitalia. The rigid protective cup or over-cup may be formed from a rigid protective material such as, for example, hard plastic, carbon fibre or Kevlar material. The rigid protective cup may be formed from a non-Newtonian material.

The garment may be an undergarment. The garment may be a brief. The garment may be trunks or shorts. The garment may be mid-length or full-length tights.

According to a second aspect of the invention, there is provided a method for forming a garment for males. The garment may comprise a moulded cup adapted for supporting the wearer's genital. The method may comprise the step of bonding a first garment fabric to one side of a foam material. The method may further comprise the step of forming a moulded cup from the foam material using a heat-machine process such that the fabric bonded to the moulded cup is on an inner surface of the cup. The method may further comprise the step of bonding a second garment fabric to the top inside edge of the moulded cup. The method may further comprise the step of bonding a third garment fabric to an outer surface of the moulded cup. The method may further comprise the step of bonding the second garment fabric to the third garment fabric to form a garment waistband, gusset, and seat/G-string of the garment.

According to a particular arrangement of the second aspect, there is provided a method for forming a garment for males, the garment comprising a moulded cup adapted for supporting the wearer's genitalia, the method comprising:

bonding a first garment fabric to one side of a foam material;

forming a moulded cup from the foam material using a heat-machine process such that the fabric bonded to the moulded cup is on an inner surface of the cup;

bonding a second garment fabric to the top inside edge of the moulded cup;

bonding a third garment fabric to an outer surface of the moulded cup; and bonding the second garment fabric to the third garment fabric to form a garment waistband, gusset and seat/G-string of the garment.

The moulded cup may comprise a rolled/rounded edge to minimise or prevent discomfort to the male wearer in particular predetermined regions of higher friction.

The edges of the moulded cup in predetermined regions may be highly tapered.

The garment may comprise a plurality of seams wherein the seams are not stitched. The seams may be bonded.

BRIEF DESCRIPTION OF THE DRAWINGS

Notwithstanding any other forms which may fall within the scope of the present invention, a preferred embodiment/preferred embodiments of the invention will now be described, by way of example only, with reference to the accompanying drawings in which.

DEFINITIONS

Figure 1:
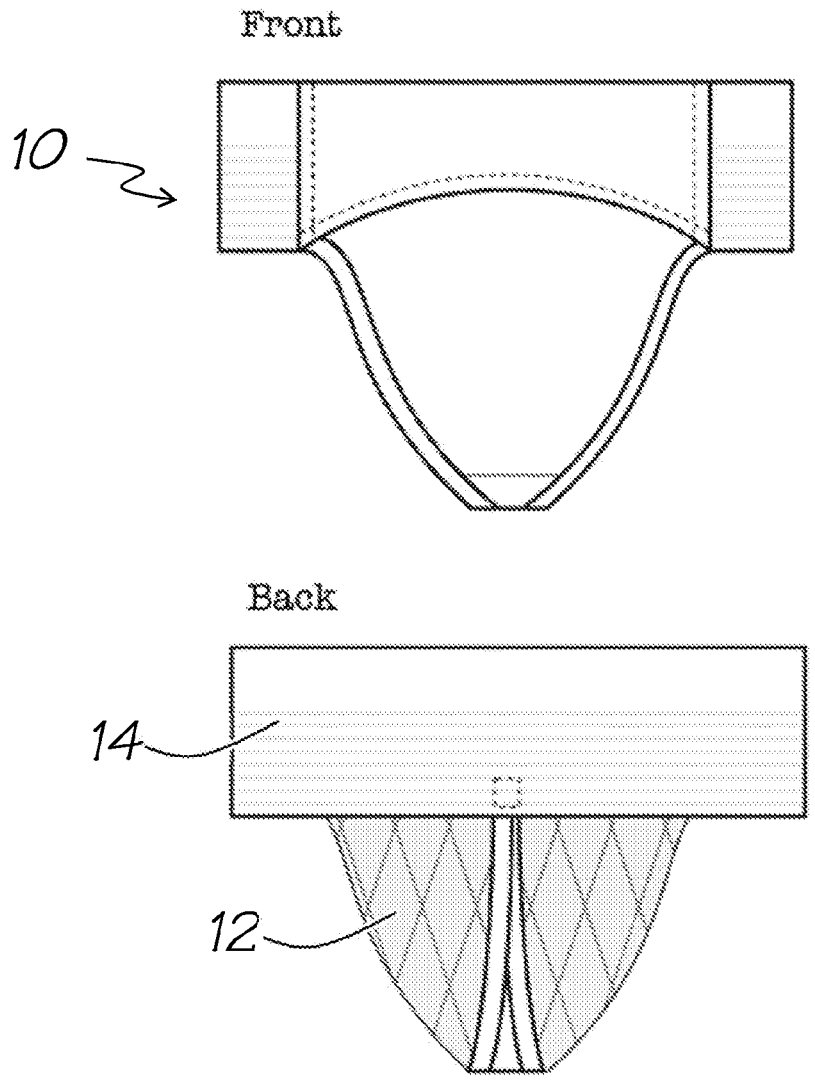
FIG. 1 shows a prior art male undergarment comprising a dance belt.

The following definitions are provided as general definitions and should in no way limit the scope of the present invention to those terms alone, but are put forth for a better understanding of the following description.

Unless defined otherwise, all technical and scientific terminology used herein have the same meaning as commonly understood by those of ordinary skill in the art to which the invention belongs. It will be further understood that terms used herein should be interpreted as having a meaning that is consistent with their meaning in the context of this specification and the relevant art and will not be interpreted in an idealized or overly formal sense unless expressly so defined herein. For the purposes of the present invention, additional terms are defined below. Furthermore, all definitions, as defined and used herein, should be understood to control over dictionary definitions, definitions in documents incorporated by reference, and/or ordinary meanings of the defined terms unless there is doubt as to the meaning of a particular term, in which case the common dictionary definition and/or common usage of the term will prevail.

For the purposes of the present invention, the following terms are defined below.

The articles "a" and "an" are used herein to refer to one or to more than one (i.e., to at least one) of the grammatical object of the article. By way of example, "an element" refers to one element or more than one element.

The term "about" is used herein to refer to quantities that vary by as much as 30%, preferably by as much as 20%, and more preferably by as much as 10% to a reference quantity. The use of the word 'about' to qualify a number is merely an express indication that the number is not to be construed as a precise value.

Throughout this specification, unless the context requires otherwise, the words "comprise", "comprises" and "comprising" will be understood to imply the inclusion of a stated step or element or group of steps or elements but not the exclusion of any other step or element or group of steps or elements.

Any one of the terms: "including" or "which includes" or "that includes" as used herein is also an open term that also means including at least the elements/features that follow the term, but not excluding others. Thus, "including" is synonymous with and means "comprising".

In the claims, as well as in the summary above and the description below, all transitional phrases such as "comprising", "including", "carrying", "having", "containing", "involving", "holding", "composed of", and the like are to be understood to be open-ended, i.e., to mean "including but not limited to". Only the transitional phrases "consisting of" and "consisting essentially of" alone shall be closed or semi-closed transitional phrases, respectively.

Although any methods and materials similar or equivalent to those described herein can be used in the practice or testing of the present invention, preferred methods and materials are described. It will be appreciated that the methods, apparatus and systems described herein may be implemented in a variety of ways and for a variety of purposes. The description here is by way of example only.

The phrase "and/or", as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of", or, when used in the claims, "consisting of" will refer to the inclusion of exactly one element of a number or list of elements. In general, the term "or" as used herein shall only be interpreted as indicating exclusive alternatives (i.e., "one or the other but not both") when preceded by terms of exclusivity, such as "either", "one of", "only one of", or "exactly one of." "Consisting essentially of", when used in the claims, shall have its ordinary meaning as used in the field of patent law.

As used herein in the specification and in the claims, the phrase "at least one", in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B", or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

For the purpose of this specification, where method steps are described in sequence, the sequence does not necessarily mean that the steps are to be carried out in chronological order in that sequence, unless there is no other logical manner of interpreting the sequence.

In addition, where features or aspects of the invention are described in terms of Markush groups, those skilled in the art will recognise that the invention is also thereby described in terms of any individual member or subgroup of members of the Markush group.

DETAILED DESCRIPTION

It should be noted in the following description that like or the same reference numerals in different embodiments denote the same or similar features.

Figure 2:
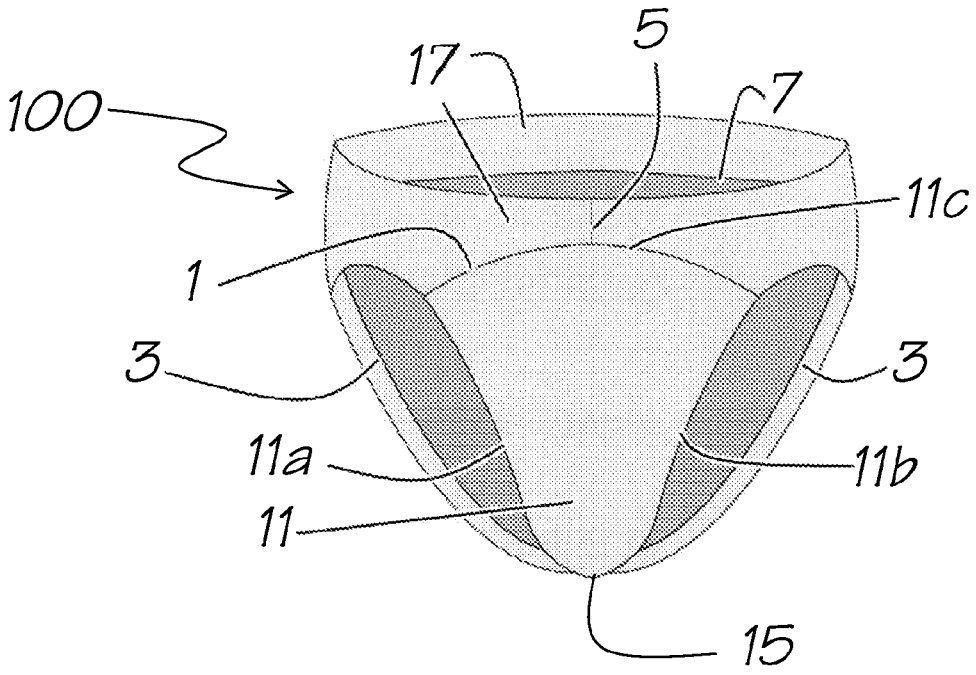
FIG. 2 shows an improved garment according to the present invention for wear by males during athletic or strenuous activity.

FIG. 2 shows a male garment 100 comprising a plurality of seams including top cup seam 1, seat edge seams 3, and waistband seams 5, and 7 particularly designed for support and protection of the male genitalia during exercise such as athletic or strenuous activity. Garment 100 comprises an integral moulded cup 11 particularly shaped to hold the male wearer's testicles and penis in substantially firm attitude against the body to restrict movement thereof during exercise such as athletic or strenuous activity, for example, in the practice of dance e.g., ballet. Moulded cup 11 may, for example, be formed from a foam material, particularly a soft foam material such as a polyurethane foam, polyester foam, ethylene vinyl acetate (EVA) foam or the like and may be similar to the moulded foam used in women's bra cups. Moulded cup 11 may be formed by a heat-machine process to conform to the appropriate shape for supporting the genitalia of the male wearer. Preferably, the thickness of moulded cup 11 varies. For example, in particular arrangements, the thickness of cup 11 graduates from thin at the edges (for example at cup edge seams 11*a*, and 11*b*, and cup top seam 11*c*) of cup 11 to thicker at the centre of cup 11. The varying thickness of cup 11 has advantages such as increased comfort to the wearer, and also acts to conceal form of the wearer's genitalia when worn underneath tight-fitting clothing (or outer garments) such as ballet tights or lycra pants and thus eliminates visual recognition of anatomical features. Moulded cup 11 provides support and protection to the male wearer's genitalia during activity by virtue of its moulded shape particularly shaped to support the male wearer's testicles and penis.

In further arrangements, the edges 11*a*, 11*b*, and 11*c* of moulded cup 11 are formed of a rolled/rounded edge to minimise or prevent discomfort to the male wearer in particular predetermined regions of higher friction, for example in gusset (or crotch) region 15 of garment 100. In other predetermined regions, such as top edge 11*c*, the edge of moulded cup 11 may be highly tapered to blend with the fabric of waistband 17 of garment 100. The edges of cup 11 are preferably smoothly varying between highly tapered and rounded in the predetermined regions thereof. Additionally, shaping along the edges of the foam changes the profile from a highly tapered to rounded edge with the aim of avoiding discomfort in areas of friction.

The custom shaped foam structure of moulded cup 11 elevates/lifts the male anatomy for comfortable and supported performance of physical activities. Garment 100 may preferably provide with optional cup size gradations to accommodate larger male genitalia and/or demographic to provide maximum support to the wearer.

Figure 3:
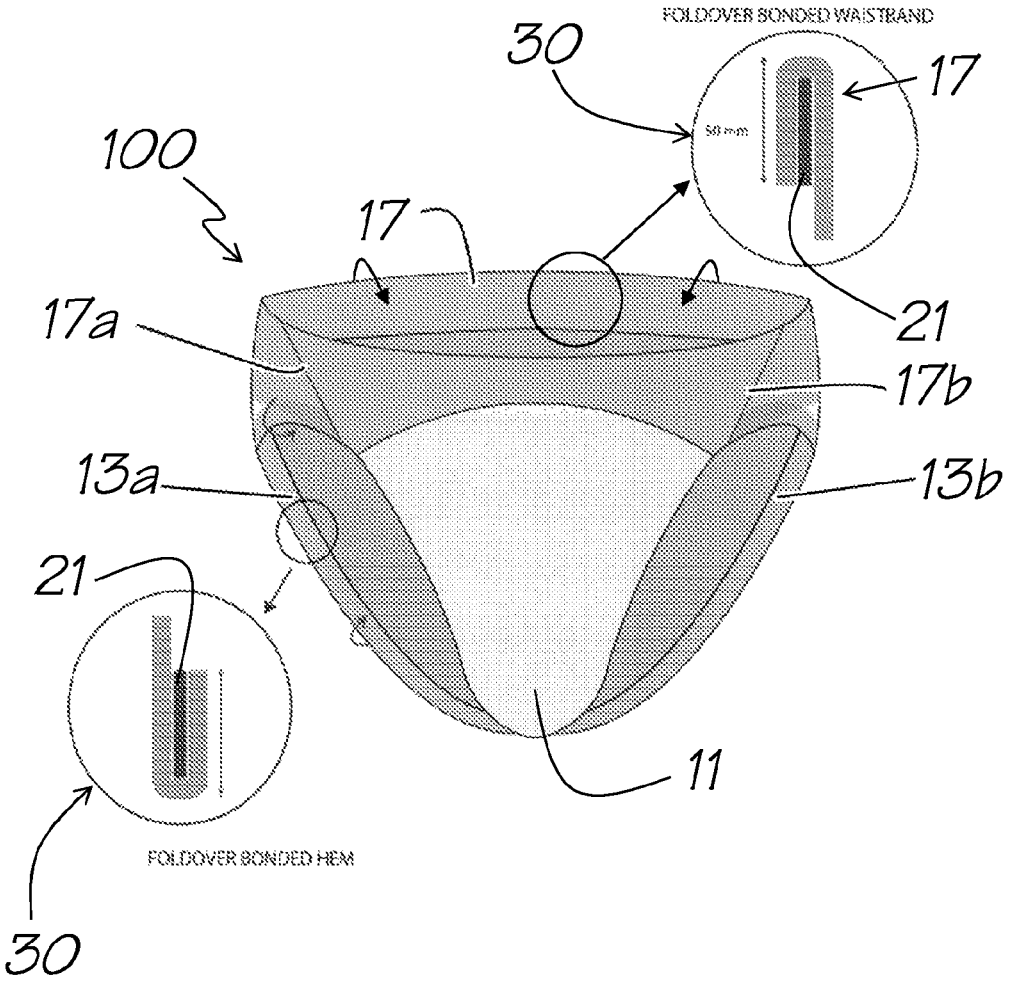
FIG. 3 shows the garment of FIG. 1 showing formation variations of the garment seams.

The seams of garment 100 (e.g., seams 1, 3, 5, and others) are not stitched. Instead, the fabric is laminated or bonded to adjacent fabric through a fabric bonding process 30 as shown in FIG. 3 wherein waistband 17 and leg seams 11*a*, 11*b* are formed by a folded fabric bonding procedure. Bonding procedure 30 generally comprises folding a fabric edge back onto itself and inserting a bonding adhesive 21 between the now adjacent fabric sections. Activation energy (e.g., heat) is then applied to the folded fabric edge to secure the fabric portions to the bonding adhesive 21. In alternate arrangements, the fabric itself may comprise a bonding adhesive integrally formed therein, thus when folded over and application of energy (e.g., heat) to the folded edge, the adjacent fabric portions are secured in fixed engagement to each other without the need for an additional bonding adhesive.

Figure 4:
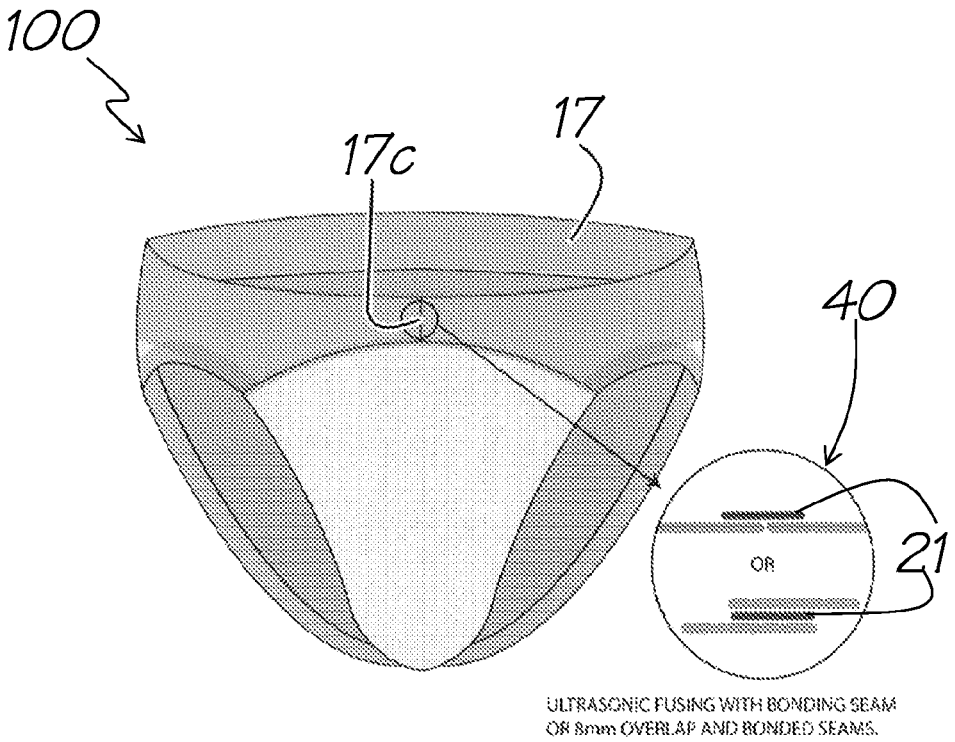
FIG. 4 shows the garment of FIG. 1 showing further formation variations of the garment seams.
Figure 5A:
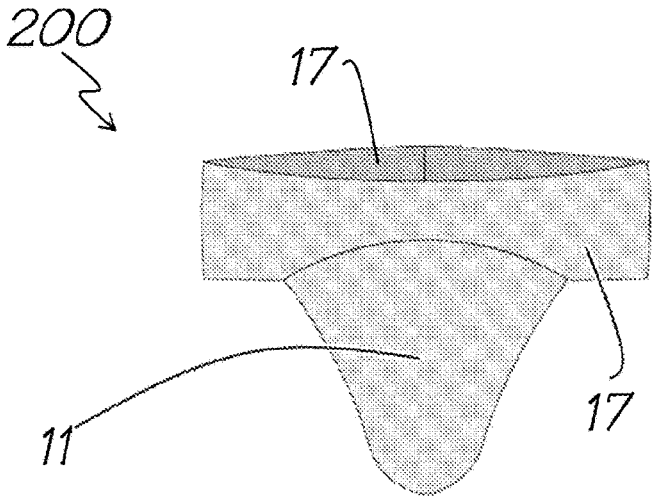
FIGS. 5A, 5B and 5C show an alternate arrangement of the garment of FIG. 1 comprising a G-string or jockstrap variant with FIG. 4 showing formation variations for particular garment seams of the G-string.
Figure 5B:
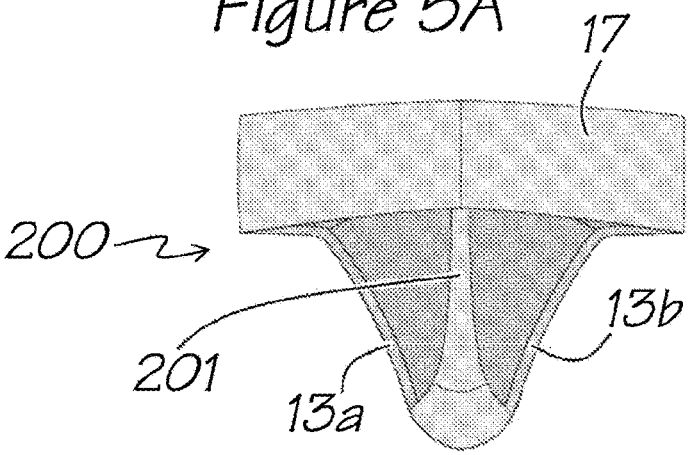
Figure 5C:
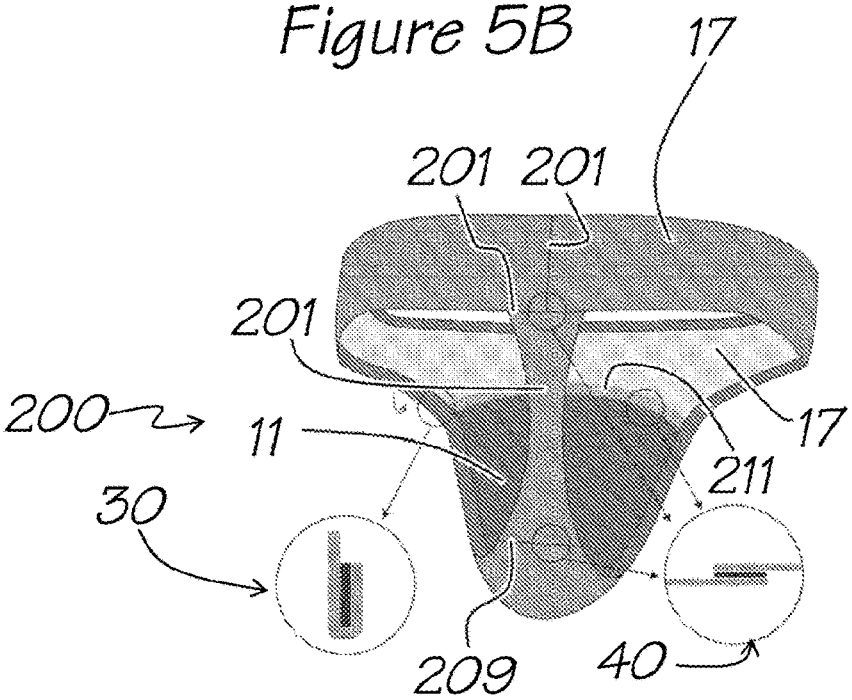
Figure 6A:
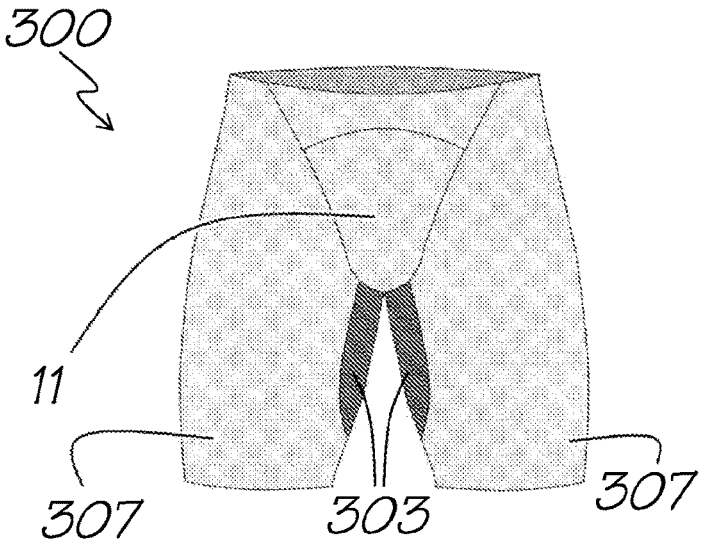
FIGS. 6A, 6B and 6C show an alternate arrangement of the garment of FIG. 1 comprising a trunk/shorts variant.
Figure 6B:
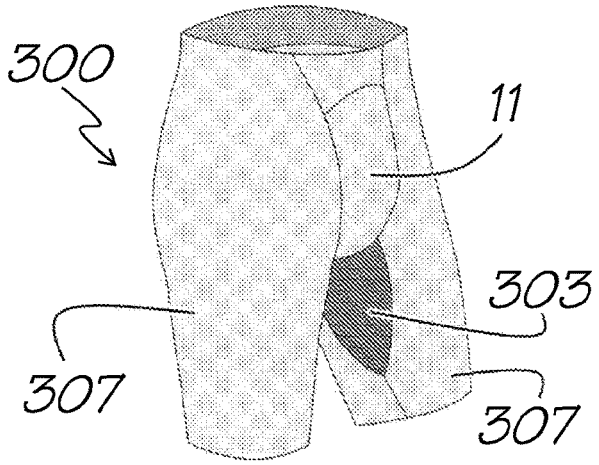
Figure 6C:
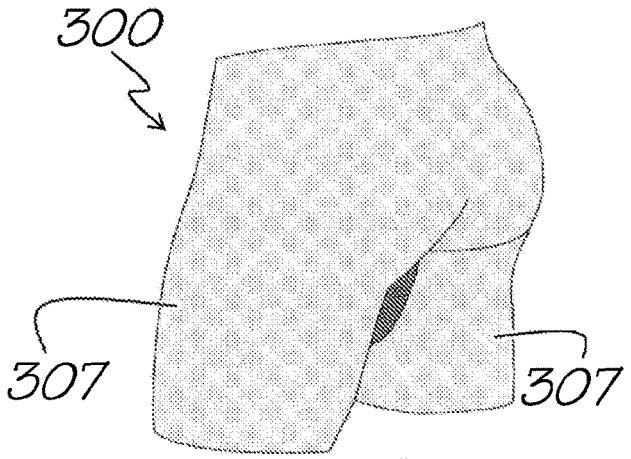

For example, in waistband 17, folding the outer fabric piece inwards and bonding it to itself creates a supportive waistband 17 eliminating the need for a woven or elastic waistband to be attached as is used in most underwear today. Leg seams 11*a*, 11*b* is also preferable formed using a folded bonding construction 30 to create a fabric strip that has a low profile and is free of bulk to provide a thin and supportive, yet comfortable solution for prolonged use during athletic or strenuous activity such as dance. In particular arrangements comprising a G-string configuration 200 as shown in FIGS. 5A to 5C rather than a full-seat arrangement as shown in FIGS. 2 to 4, it will be readily appreciated by the skilled addressee that the G-string element 201 is in effect simply the left and right leg seams 13*a* & 13*b* situated in close proximity to each other such that the G-string element 201 is configured to locate between the users buttocks in use. Similarly, therefore, G-string element 201 in such arrangements would also comprise a folded bonded seam construction 30 to create a fabric strip that has a low profile and is free of bulk to provide a thin and supportive, yet comfortable solution for prolonged use during athletic or strenuous activity.

Preferably, predetermined, and specific thicknesses of bonding adhesive 21 are applied in different areas of garment 100 to achieve the correct balance of support and stretch. For example, the finish of waistband 17 is firmer to provide more support compared to the leg seam or G-string element where more stretch is required for comfort. Through the use of fabric bonding, it has also been possible to use very lightweight, breathable fabrics to achieve the performance characteristics of much heavier and bulkier fabrics. This in-turn has created a garment that is far more comfortable to train and perform in and almost undetectable when worn under tights as the elimination of sewn seams and the foam structure provide a seamless finish that is aesthetically pleasing.

In particular arrangements, moulded cup 11 may be bonded to an outer fabric layer wherein the fabric layer is folded over the edges of cup 11 and bonded thereto to form cup edge seams 11*a* and 11*b*. Upper edge of the outer fabric layer of cup 11 may be bonded to waistband 17 or may be integrally formed with the fabric forming waistband 17. Integral formation of the waistband 17 with cup 11 as the advantage of eliminating top cup seam 11*c* or other front seams at the connection point which would otherwise be necessary.

In a particular construction arrangement, the foam which is to form the cup is laminated on one side to fabric and this composite structure is pressed into shape at the one time to create the moulded cup 11. At this stage, the fabric side is the side that sits against the body. The top inside edge of this composite moulded structure is then bonded to a separate fabric piece which becomes the inside panel piece of the waistband of garment 100. Looking from the outside (front view) of the garment 100 now the foam of the cup 11 is exposed at this point. The top edge of the foam cup 11 (typically about 8 mm but may be between about 5 and 15 mm) is bonded at top cup seam 11*c* to a separate piece of fabric that ends up enveloping the rest of the foam cup 11 as seen from the outside/front of garment 100. These outer and inner fabric panels are completely bonded together to form cup seam 11*a* above the moulded cup 11 to act as the waistband. The top edge of the foam cup 11 (inner and outer) sides end up sandwiched and bonded between the two pieces of fabric to hold the structure in place.

A variation of folded bonding process 30 may preferentially be applied for alternative seam variations where folding of the fabric back upon itself is not possible. For example, optional waistband seams 17*a* and 17*b* of FIG. 3 or optional waistband seam 17*c* of FIG. 4 may be formed by an overlapping-type fabric bonding process 40 shown in detail relief in FIG. 4 alternatively known as either ultrasonic fusing with bonded seam or overlapping bonded seam, and may be achieved either with a bonding adhesive 21 between the fabric layers or edges to be bonded or alternatively through activation via energy (e.g., heat) of a bonding element integrally formed with the fabric. Use of such bonding techniques enables the formation of garment 100 as an effectively seamless garment design integrating each element (e.g., waistband, cup, and G-string/seat). Overlapped bonded seam type 40 may advantageously be used during construction of the garment for waistband seams 205 and 207, crotch seam 209 and top cup seam 211.

Various bonded seam arrangements applicable in the formation of the present garment 100 are described in, for example, US 2007/0181241 A1 (Kramer et al), U.S. Pat. No. 6,521,067 B1 (Clark) and others as would be appreciated by the skilled addressee.

It will readily be appreciated that the garment 100 disclosed above may be adapted for use as an undergarment such as a dance belt specifically applicable to the requirements of male dancers or gymnasts designed to be worn underneath tight fitting outer garments such as tights with minimal visibility of the seams of garment 100 showing through the outer garment and also, through integral moulded cup 11, maximising the privacy of the wearer by masking the detailed form of the wearer's genitalia visible to observers. This provides an aesthetically pleasing look of the wearer's appearance to the audience/observer. In this application as an undergarment, garment 100 may be formed as a brief as shown in FIGS. 2 to 4, or alternatively as a G-String variation (as shown in FIGS. 5A, 5B and 5C) or a trunk/shorts variation 300 as shown in FIGS. 6A to 6C and FIG. 7 also comprising an integral moulded cup 11 for supporting the genitalia of the male wearer. Garment 200 or 300 may also comprise bonded seams in a similar manner to those of garment 100 such that garment 200 or 300 may also be worn under tight fitting outer garments such as tights as desired.

Figure 8A:
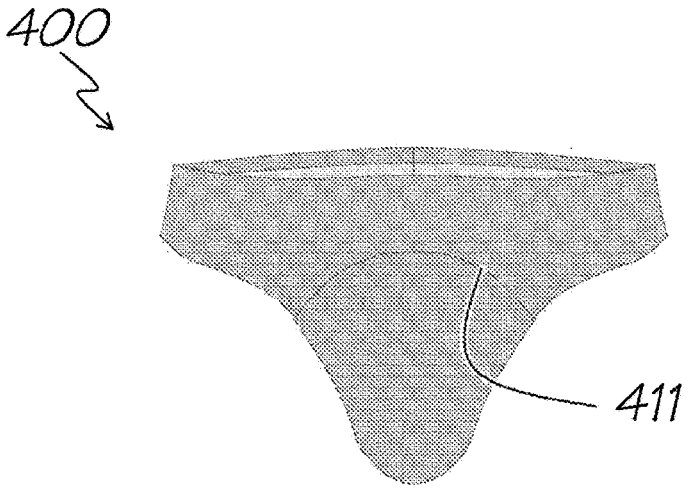
FIGS. 8A to 8C show an alternative embodiment of the garment of FIGS. 5A to 5C.
Figure 8B:
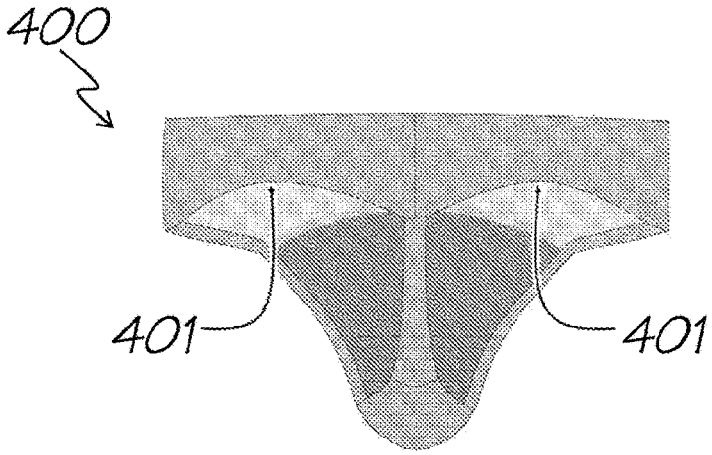
Figure 8C:
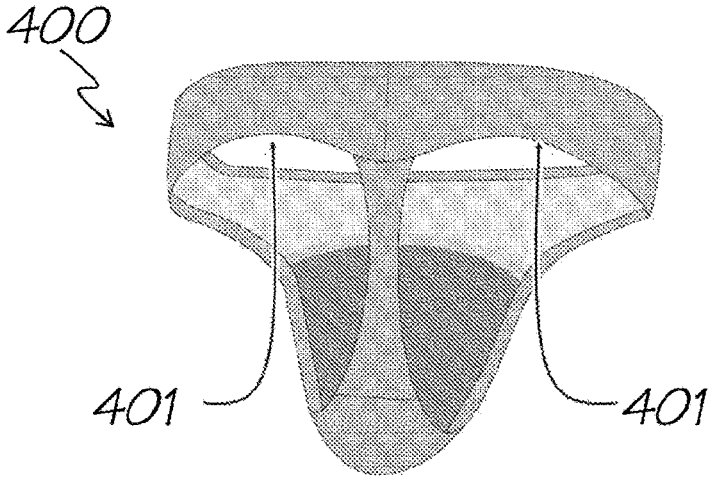
Figure 9:
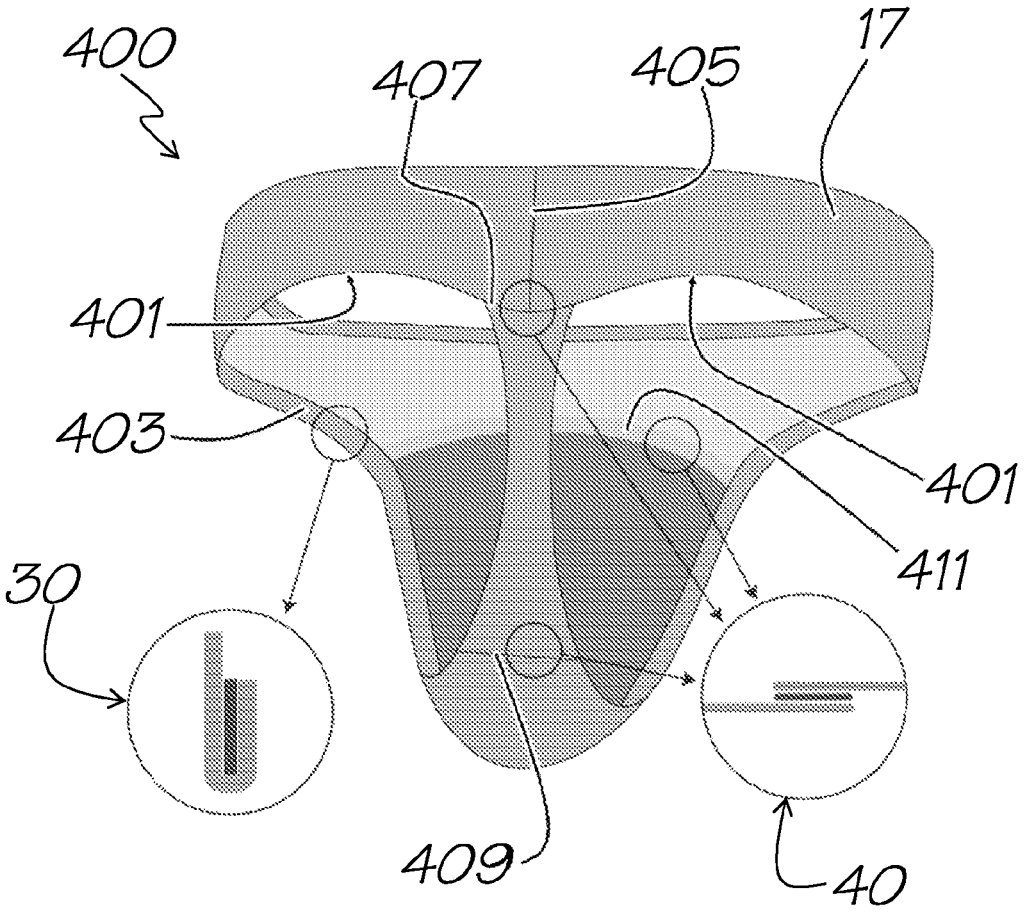
FIG. 9 shows a detail of the seam construction of the embodiment of FIG. 8A.

FIGS. 8A to 8C depict a further arrangement 400 of garment 200 as depicted in FIG. 5A. Garment 400 includes the additional feature of cutaways 401 in the seat region of the garment 400 configured to provide additional comfort to the wearer and to prevent bunching of the garment 400 in the seat region which may cause discomfort to the wearer and/or provide an undesirable aesthetic when worn under tights e.g., during a dance performance. FIG. 9 shows a further view of arrangement 400 detailing the bonded seam types 30 and 40 which may be used in construction of garment 400 at particular seam locations to maintain low profile, thin, and supportive seams providing a comfortable solution to the wearer for prolonged use during athletic or strenuous activity such as, for example, dance or athletic activity. For example, folded bonded seam type 30 may be advantageously used for leg seams 403, and overlapping bonded seam type 40 may be advantageously used for waistband 17 seams 405 and 407, crotch seam 409 and cup top seam 411.

In a further arrangement of garment 300 the length of the legs 307 may be extended to any desired length (not shown) as would be readily appreciated by the skilled addressee, for example to knee length for a mid-length tights variant or alternatively to the ankle for a full-length tights' variant Alternatively, garment 100, 200 or 300 may be adapted to be worn as an outer garment, for example swimming briefs. Designated use as a swimming brief may necessitate that moulded cup be formed from a water-resistant material to minimise expansion when wet or other complications such as reduced lifetime of the garment.

Figure 7:
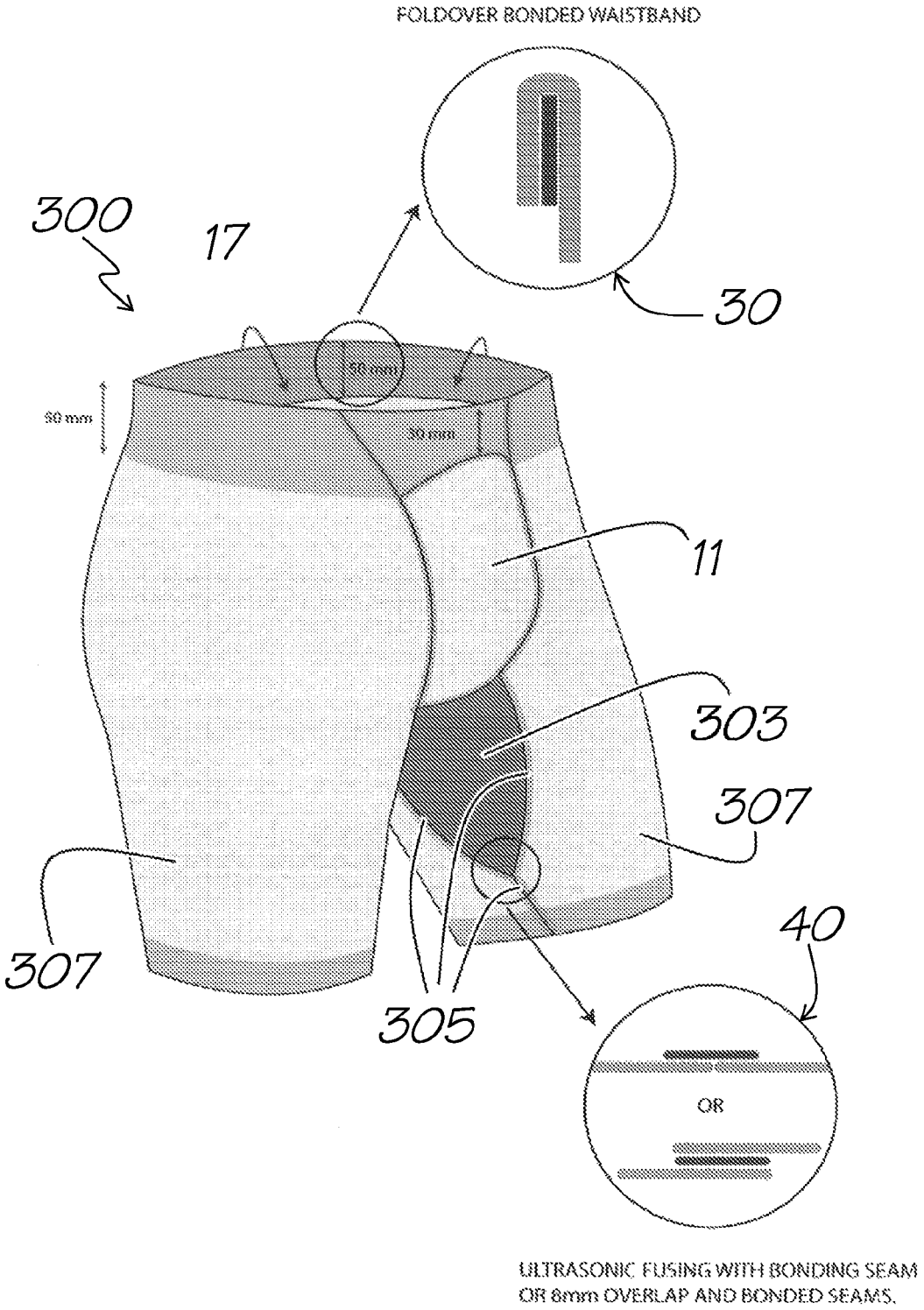
FIG. 7 shows the garment variant of FIG. 6A showing formation variations of the garment seams.

Similarly, trunk/shorts variant garment 300 may be configured to be worn as an outer garment negating the necessity for separate undergarment since garment 300 simultaneously provides support for the male wearer's genitalia during activity and also functional advantages for specifics activities, for example prevention of chaffing between the wearer's upper thighs such as may be evident during running, or cycling activity or the like. In particular arrangements, garment 300 may comprise additional fabric reinforcement in the inner leg/upper thigh region 303 to maximise the resistance to chaffing during athletic or strenuous activity. FIG. 7 shows trunk/shorts variant garment 300 along with a particular arrangement of seam bonding techniques applicable to particular seams including a fold-over bonded seam 30 variation e.g., for waistband 17 and ultrasonic fusing or overlap with bonded seam 40 for inner leg seams 305.

Further variations of garment 300 would advantageously comprise a full tight (not shown, however as would be readily appreciated as similar to garment 300 albeit with extended leg covering) configured to be worn during activity (e.g., dance, gymnastics, aerobics, yoga or the like) without requiring the addition of a separate undergarment to be worn underneath the full tights since the full tight provides both support and privacy for the male wearer's genitalia and also a functional garment for the particular activity being undertaken.

It will also readily be appreciated that garments 100, 200, 300 or variants thereof may be applicable for use in various activities e.g., dance, gymnastics, athletics, casual gym activity, weightlifting, wrestling or the like, sports (soccer, hockey, tennis and the like), and by professional personnel e.g., worksite, military or the like, or even in general usage according to the preference of the male wearer.

In alternate arrangements, moulded cup 11 may be a protective cup formed from a rigid protective material such as, for example, hard plastic, carbon fibre or Kevlar material or the like for use as a protective device for male players of ball sports such as cricket or hockey. A rigid protective cup may be used in conjunction with a foam moulded cup 11 on the inside surface of the rigid cup of for the wearer's comfort. In particular arrangements, garment 100 having an integrally formed foam moulded cup 11 may further comprise a pocket opening adapted to receive a rigid protective over-cup insert to fit over integral foam moulded cup 11 to provide impact protection for the male wearer's genitalia. A rigid protective cup used in conjunction with moulded cup 11 is advantageous rather than simply interchanging moulded cup 11 with a rigid protective cup insert. In particular arrangements, the protective rigid cup insert is configured as an over-cup particularly configured to encase the soft foam moulded cup 11 structure to protect the wearer's genitals from a potential impact, whilst maintaining the comfort and feel of soft moulded cup 11. In this arrangement, the rigid over-cup insert is configured to be held in place within garment 100, 200, or 300 (or variants thereof) by the outer lining of moulded foam cup 11.

In a particular alternate arrangement, moulded cup 11 may be formed of a non-Newtonian material such as, for example, the impact resistant material available from D3O (Croydon CR0 4XA, United Kingdom). The D3O polymer material comprising long chains of repeated monomer units strung together to yield giant macromolecules, is particularly advantageous for wearable protection. It is pliable under low sheer stresses and when used as mounded cup 11 would form a comfortable snug fit which moves with the wearer's movements. When exposed to high sheer stresses such as an impact from an external object such as, for example, a ball, the non-Newtonian polymer instantly hardens to dissipate the impact forces. Thus, use of this type of non-Newtonian polymer material for moulded cup 11 would provide significant advantage to the garment 100 and its applicability for use as a protective device for male players of ball sports such as cricket or hockey.

In further arrangements, the garment may be provided with a removable cup 11 so that moulded foam cup 11 may be replaced with a rigid protective cup formation for use in ball sports such as cricket, hockey or the like to provide protection for the wearer against ball impacts to the groin.

As described above, the outer fabric piece minus the moulded foam cup 11 is also moulded but separately (to the moulding of the cup) in the manufacturing process. This currently occurs on the front outer fabric piece which drapes over the top the foam cup 11. As mentioned above, this front, outer piece is not completely glued/bonded to the foam cup 11 (apart from the top edge) and is folded over the edges then bonded onto the inside fabric panel to secure it in place. If the foam cup was not securely integrated into the garment at all, the product would essentially be a double skinned/walled underpant. In this particular arrangement, a rigid cup could be inserted between the two pieces of fabric to act as a cup which could be inserted or removed in accordance with requirements via an opening for insertion and removal in garment 100. Alternatively, the garment 100 could be manufactured with the rigid cup 11 enclosed permanently within the fabric panel pieces as per the moulded foam cup 11 arrangements described above.

Alternatively, still, the garment may be provided with a pouch adapted to receive a rigid protective cup to complement the moulded foam cup 11 to provide additional comfort to the wearer. This arrangement may be implemented by providing a laser cut, inconspicuous slit on the front fabric panel piece where the rigid cup would be inserted to sit/stack on top of the foam cup 11 of the garment 100.

In particular arrangements, garments 100, 200 or 300 as disclosed herein may be referred to as Technical Garments or Technical Undergarments specifically adapted to provide targeted support to the male genitalia during athletic or strenuous activity.

Interpretation

In Accordance With

As described herein, 'in accordance with' may also mean 'as a function of' and is not necessarily limited to the integers specified in relation thereto.

Embodiments

Reference throughout this specification to "one embodiment", "an embodiment", "one arrangement" or "an arrangement" means that a particular feature, structure or characteristic described in connection with the embodiment/arrangement is included in at least one embodiment/arrangement of the present invention. Thus, appearances of the phrases "in one embodiment/arrangement" or "in an embodiment/arrangement" in various places throughout this specification are not necessarily all referring to the same embodiment/arrangement, but may. Furthermore, the particular features, structures or characteristics may be combined in any suitable manner, as would be apparent to one of ordinary skill in the art from this disclosure, in one or more embodiments/arrangements.

Similarly it should be appreciated that in the above description of example embodiments/arrangements of the invention, various features of the invention are sometimes grouped together in a single embodiment/arrangement, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment/arrangement. Thus, the claims following the Detailed Description are hereby expressly incorporated into this Detailed Description, with each claim standing on its own as a separate embodiment/arrangement of this invention.

Furthermore, while some embodiments/arrangements described herein include some but not other features included in other embodiments/arrangements, combinations of features of different embodiments/arrangements are meant to be within the scope of the invention, and form different embodiments/arrangements, as would be understood by those in the art. For example, in the following claims, any of the claimed embodiments/arrangements can be used in any combination.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Scope of Invention

Thus, while there has been described what are believed to be the preferred arrangements of the invention, those skilled in the art will recognize that other and further modifications may be made thereto without departing from the spirit of the invention, and it is intended to claim all such changes and modifications as fall within the scope of the invention. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It will be appreciated that the garments described/illustrated above at least substantially provide a garment for males comprising a moulded cup garments configured to provide support to the male genitalia during athletic or strenuous activity.

The garments described herein, and/or shown in the drawings, are presented by way of example only and are not limiting as to the scope of the invention. Unless otherwise specifically stated, individual aspects and components of the garments may be modified, or may have been substituted therefore known equivalents, or as yet unknown substitutes such as may be developed in the future or such as may be found to be acceptable substitutes in the future. The garments may also be modified for a variety of applications while remaining within the scope and spirit of the claimed invention, since the range of potential applications is great, and since it is intended that the present garments be adaptable to many such variations.

The invention claimed is:

1. A garment for males configured to provide support to the wearer's genitalia during athletic or strenuous activity, the garment comprising:

a moulded supportive structure comprising a moulded foam cup that maintains the genitalia in a supported and positioned configuration against the lower abdominal area during dynamic movement, independent of compression from a waistband;

wherein the moulded foam cup has a thickness profile that varies across the cup to provide both structural support to the genitalia and concealment of the form of the wearer's genitalia when worn underneath tight-fitting clothing;

wherein the moulded foam cup comprises edge regions in predetermined locations that are rounded to reduce friction and discomfort in areas of higher friction during movement, and tapered in other predetermined locations to blend substantially seamlessly with adjacent fabric of the garment; and wherein the garment comprises low-profile seams that are bonded and configured to be substantially invisible underneath tight-fitting outer garments.

2. The garment of claim 1, wherein the moulded supportive structure is a moulded foam cup.

3. The garment of claim 2, wherein the seams are formed from a folded bond, ultrasonic-fused bond or overlap-bonded seam.

4. The garment of claim 1, wherein the moulded supportive structure is formed from a foam material comprising:

polyurethane foam;

polyester foam; or ethylene-vinyl acetate (EVA) foam.

5. The garment of claim 1, wherein the moulded supportive structure is configured to support the genitalia of the male wearer.

6. The garment of claim 1, wherein the garment is an undergarment.

7. The garment of claim 1, wherein the moulded supportive structure comprises regions having a highly tapered edge to blend with the fabric of a waistband of the garment.

8. The garment of claim 1, wherein regions of the edges of the moulded supportive structure are smoothly varying between highly tapered and rounded.

9. The garment of claim 1, further comprising a receiving pouch adapted to receive a moulded protective cup formation formed of a rigid material adapted to provide impact protection to the wearer's genitalia.

10. The garment of claim 9 wherein the moulded protective cup formation is formed from a rigid protective material such as, for example, hard plastic, carbon fibre or Kevlar material.

11. The garment of claim 9, wherein the moulded protective cup formation is formed from a non-Newtonian material.

12. The garment of claim 1, wherein the moulded protective cup comprises a rigid over-cup formed of a rigid material configured to encase the moulded cup, the rigid over-cup being adapted to provide impact protection to the wearer's genitalia.

13. The garment of claim 1, wherein the garment is either a brief, trunks, shorts, or mid-length or full-length tights to be worn during athletic or strenuous activity.

14. The garment of claim 1, wherein the edge regions smoothly vary along their length between the rounded configuration in the predetermined higher-friction locations and the tapered configuration in the predetermined waistband-blending locations.

* * * * *